US006062019A

United States Patent [19]

Staufenberg

[11] Patent Number: 6,062,019

[45] Date of Patent: May 16, 2000

[54] METHOD FOR CONTROLLING THE FUEL/AIR RATIO OF AN INTERNAL COMBUSTION ENGINE

[75] Inventor: Ulrich Staufenberg, Diethardt, Germany

[73] Assignee: Mannesmann VDO AG, Frankfurt, Germany

[21] Appl. No.: 09/010,208

[22] Filed: Jan. 21, 1998

[30] Foreign Application Priority Data

Nov. 25, 1997 [EP] European Pat. Off. ..... 97120602

[51] Int. Cl.[7] ..... F01N 3/00

[52] U.S. Cl. ..... 60/285; 60/274; 60/276; 60/277; 701/109

[58] Field of Search ..... 60/274, 276, 277, 60/285, 286; 701/109

[56] References Cited

U.S. PATENT DOCUMENTS

| | | | |
|---|---|---|---|
| 5,115,639 | 5/1992 | Gopp | 60/274 |
| 5,319,921 | 6/1994 | Gopp | 60/274 |
| 5,438,827 | 8/1995 | Ohuchi et al. | 60/276 |
| 5,511,377 | 4/1996 | Kotwicki | 60/274 |
| 5,528,899 | 6/1996 | Ono | 60/276 |
| 5,598,703 | 2/1997 | Hamburg et al. | 60/285 |

FOREIGN PATENT DOCUMENTS

| | | |
|---|---|---|
| 3500594 | 7/1986 | Germany . |
| 4117476 | 12/1991 | Germany . |
| 4024210 | 2/1992 | Germany . |

*Primary Examiner*—Thomas Denion
*Assistant Examiner*—Binh Tran
*Attorney, Agent, or Firm*—Martin A. Farber

[57] ABSTRACT

A method of controlling the fuel/air ratio of an internal combustion engine in which the output signal of a first lambda probe which is arranged in the exhaust gas passage in front of a catalytic converter of the internal combustion engine is fed to a controller which has a proportional-and-integral (PI) characteristic. The controller gives off a setting variable for the fuel/air ratio. A further signal which is obtained from the output signal of a second lambda probe arranged behind the catalytic converter is fed to the controller and acts on the control circuit of the first lambda probe.

In order to permit an accurate, adaptable control, the proportional portion of the output signal of the control circuit of the first lambda probe is modified as a function of the output signal of the second lambda probe.

10 Claims, 3 Drawing Sheets

METHOD FOR CONTROLLING THE FUEL/AIR RATIO OF AN INTERNAL COMBUSTION ENGINE

FIELD AND BACKGROUND OF THE INVENTION

The present invention relates to a method for controlling the fuel/air ratio of an internal combustion engine in which the output signal of a first lambda probe, which is arranged in the exhaust gas passage of the internal combustion engine in front of a catalytic converter, is fed to a controller which has a proportional-plus-integral characteristic. The controller gives off a setting variable for the fuel/air ratio, and the controller is fed a further signal which is obtained from the output signal of a second lambda probe arranged behind the catalytic converter and acts on the control circuit of the first lambda probe.

In order to obtain exhaust gases which are as free of injurious substances as possible, control devices for internal combustion engines are known in connection with which the oxygen content in the exhaust gas canal is measured and evaluated. For this purpose, oxygen measurement probes, so-called lambda probes, are known, which operate for instance in accordance with the principle of ion conduction by a solid electrolyte as a result of an oxygen partialpressure difference corresponding to the oxygen partial pressure present in the exhaust gas, the probes give off a voltage signal which, upon change from oxygen deficit to oxygen surplus or vice versa, exhibits a change in voltage.

The output signal of the lambda probe is evaluated by a controller which, in its turn, adjusts the fuel/air mixture again via an actuating member.

By the control of the fuel/air ratio, it is desired primarily to reduce the injurious portions of the exhaust gas emission of internal combustion engines.

By means of a second lambda probe which is arranged behind the catalytic converter, the signal of the first lambda probe is corrected, since the probe is subject to aging phenomena.

Despite this superimposed control, the aging phenomena of the first lambda probe, are not sufficiently corrected. This leads to irregularities in the formation of the mixture.

SUMMARY OF THE INVENTION

It is an object of the invention to provide a method which makes it possible to obtain a precise, adaptable control so that the fuel/air ratio is improved further in the sense of a reduction of the emission of exhaust gases.

In accordance with the invention, this object is achieved in the manner that the proportional portion of the output signal of the control circuit of the first lambda probe is changed as a function of the output signal of the second lambda probe.

The advantage of the invention resides in a rapid recoupling of the output signal of the second lambda control circuit on the control circuit of the first lambda probe, by changing the voltage jump of the output signal of the first lambda probe.

From the control deviation between an actual value and a desired value of the second lambda probe, there is formed a correction signal by which the proportional portion of the first lambda control circuit is increased when the sign of the difference in control of the first lambda control circuit corresponds to the trend towards change of the first lambda probe and the proportional portion of the first lambda control circuit is reduced when the sign of the difference in control of the trend towards change of the first lambda probe is opposite thereto.

Due to the fact that the correction signal acts by multiplication on the proportional portion of the control circuit of the first lambda probe, the proportional portion of the control circuit is increased or reduced.

In one embodiment, the correction signal is formed from the second lambda control circuit at the time of the reversal of the first lambda control probe arranged in front of the catalytic converter and then fed to the control circuit of the first lambda probe.

The proportional portion of the first control circuit is thus influenced by a correction value which is dependent on the period of time that the output signal of the first lambda probe actually lasts.

In a further development, the correction signal is formed as a function of the air mass flow and/or of the ratio of the amplitude of the second lambda probe to the amplitude of the first lambda probe.

The efficiency of the catalytic converter is taken into account upon the correction of the first control signal by means of the amplitude ratio.

The amplitude of both the first and the second lambda probes is determined by discrete scanning of the output signal of each lambda probe, a mean value from which the amplitude ratio is determined being formed from the scanning within a time window.

The correction signal is advantageously weighted as a function of the sign of the deviation of the control of the second lambda control circuit.

THE DRAWINGS

With the above and other objects and advantages in view, the present invention will become more clearly understood in connection with the detailed description of a preferred embodiment, when considered with the accompanying drawings, of which:

DETAILED DESCRIPTION OF THE PREFERRED EMBODIMENT

Figure 1:
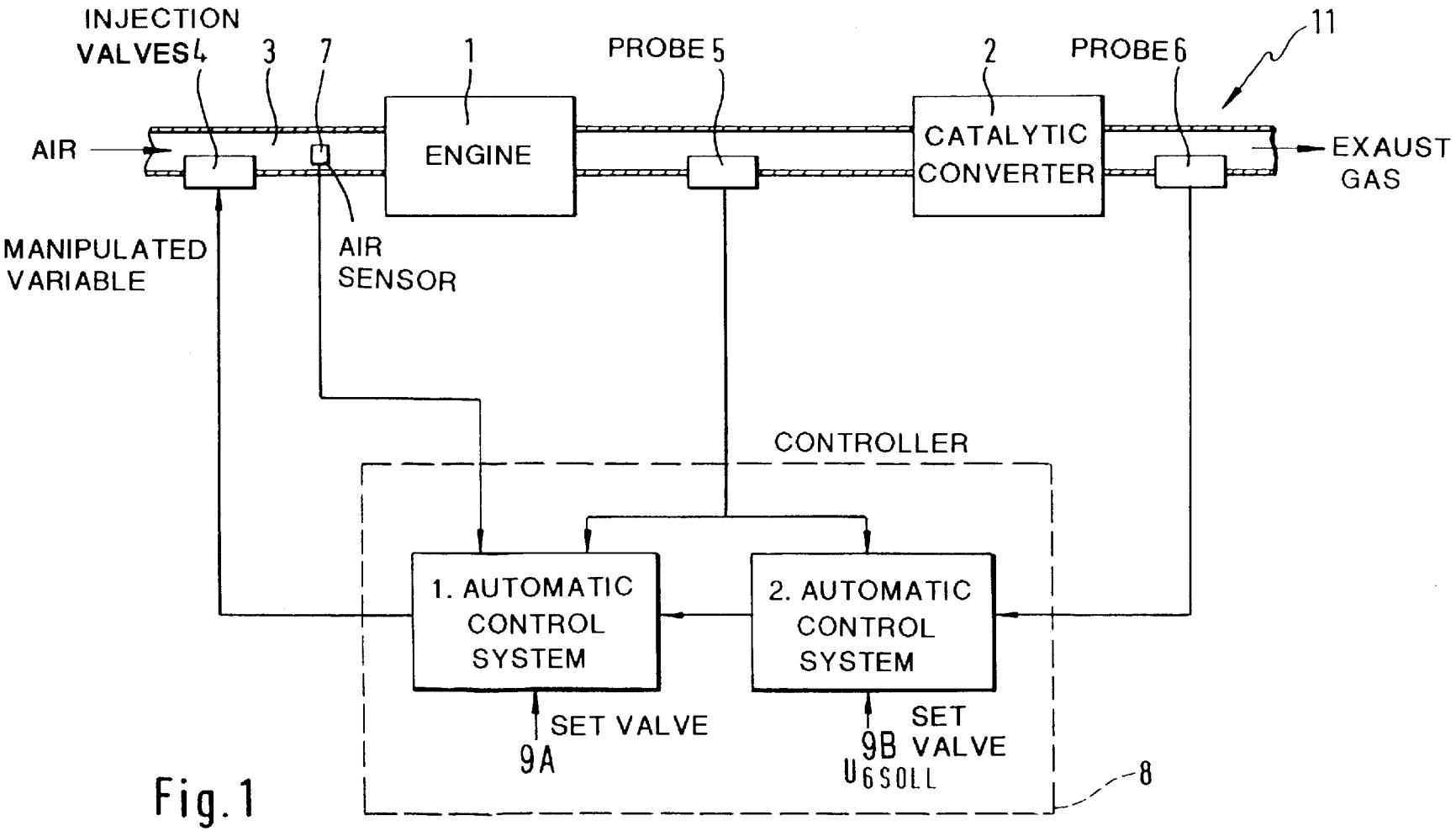
FIG. 1 is a diagrammatic showing of a device for controlling the fuel/air mixture for an internal combustion engine.

Referring to FIG. 1, the device consists of an internal combustion engine, having a catalytic converter 2. Air is fed to the motor 1 via an intake manifold 3.

The fuel is injected into the intake manifold 3 via injection valves 4.

Between motor 1 and catalytic converter 2 there is a first lambda probe 5 for detecting the exhaust gas. A further lambda probe 6 is provided in the exhaust gas passage behind the catalytic converter 2. The lambda probes 5 and 6 measure the corresponding lambda value of the exhaust gas in front of and behind the catalytic converter 2. Both the signals supplied by the lambda probes 5 and 6 are fed to a controller 8 having a proportional-plus-integral characteristic, the controller being located ordinarily in the control device (FIG. 2) in the motor vehicle.

An actuating signal which is fed to the injection valves 4 is formed from said signals of the probes by the controller 8 with the aid of desired (set) values 9A and 98.

This actuating signal to the injection values leads to a change in the feed of the fuel which, together with the amount of air drawn in, results in a given lambda value of the exhaust gas.

Figure 2:
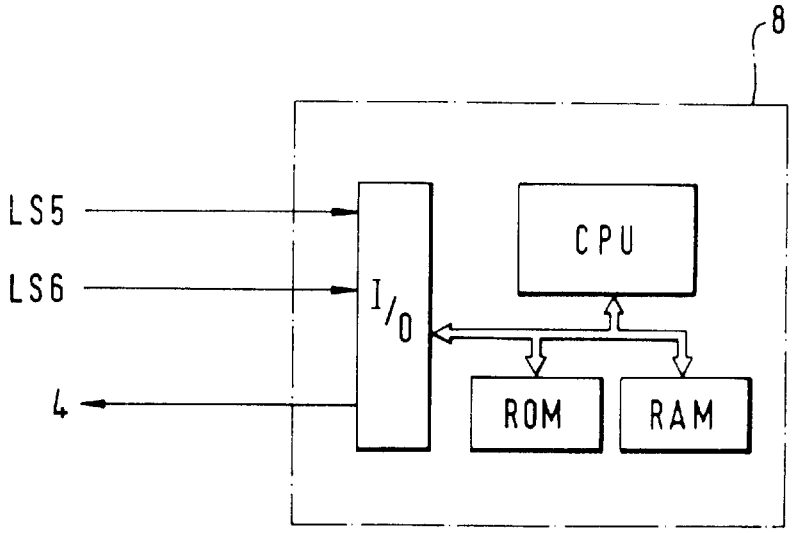
FIG. 2 shows the control device of a motor vehicle.

As shown in FIG. 2, the controller 8 is a microcomputer consisting of a central processing unit CPU, a random-access memory RAM, and a read-only memory ROM. The controller 8 evaluates both the signals of the first lambda probe 5 and the signals of the second lambda probe 6 which are fed to it via its input/output unit I/O and processes the signals further.

The controller 8 evaluates the signal of the first lambda probe 5 by comparing the existing value with the desired value 9A (FIG. 1) for the lambda probe 5 which is stored in the readonly memory ROM, and determines therefrom as setting variable an injection time by which the fuel/air mixture is regulated. The evaluation of the second lambda control circuit is superimposed on this comparison, as explained in further detail in connection with FIG. 4. The result of the second lambda control circuit is represented in the determination of the hold time TH. This hold time TH has the result that the action of the controller 8 on the injection valves 4 which takes place as a function of the comparison of the first control circuit is effected with time delay.

The control path 11 is in this connection the combustion process in the motor 1 which is controlled via the injection time as setting variable and the injection valves as setting members.

Figure 3:
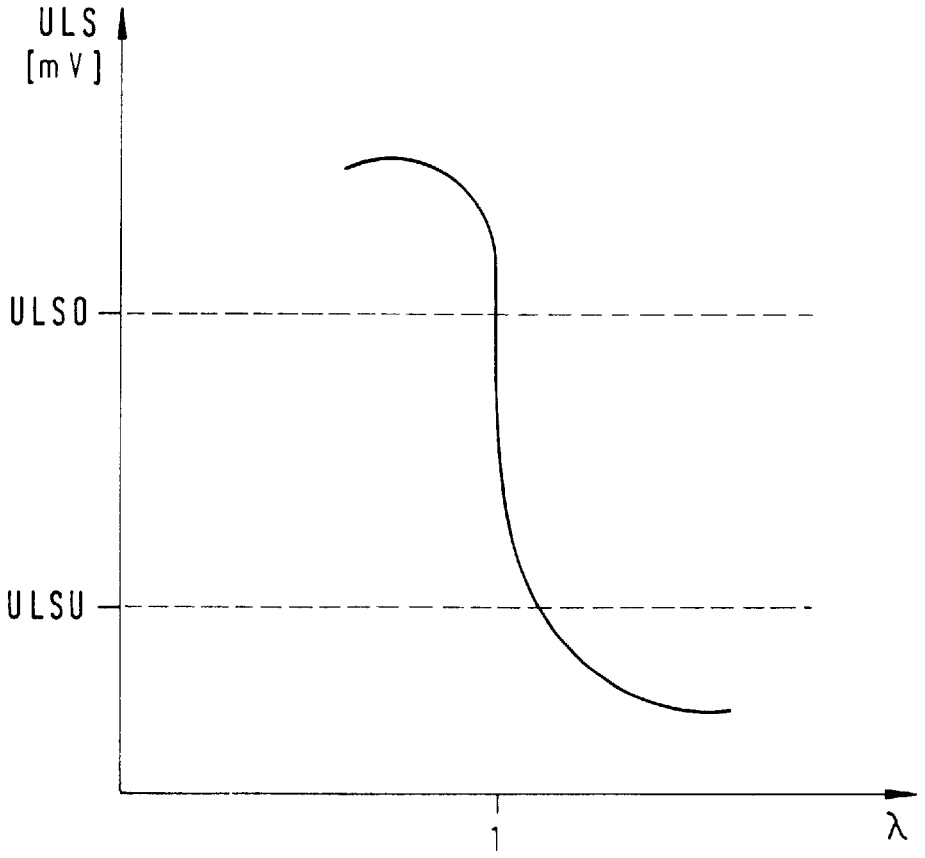
FIG. 3 shows the variation of the voltage of a lambda probe over the fuel/air mixture ($\lambda$ factor)

A signal course such as shown in FIG. 3 is supplied for each pressure via the λ factor which represents the specific fuel/air mixture. Depending on what type of lambda probe is used for the control, either the resistance or the voltage as a function of the λ factor can be considered.

The following remarks refer to the signal voltage.

If either one of the probes is active, then it has a signal voltage which is outside the region (ULSU, ULSO). During the lean deflection, the lambda probe supplies a minimum output signal which lies below ULSU. During the rich deflection, a maximum voltage signal above ULSO in a region of 600 to 800 mV is measured. This maximum value is subject, due to manufacturing tolerances and aging phenomena, to certain dispersions which are corrected by a probe-correction factor.

Figure 4:
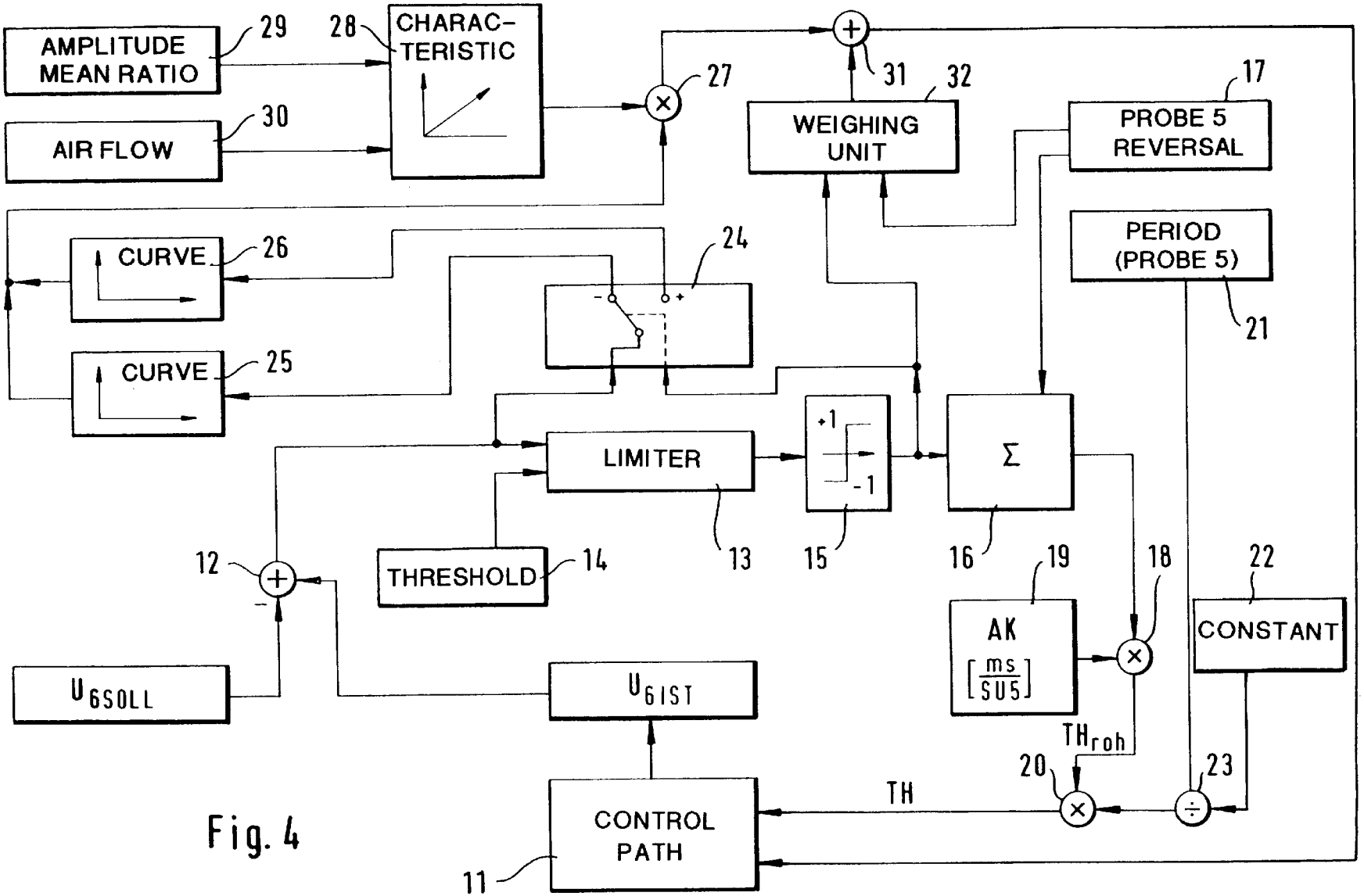
FIG. 4 shows the closed-cycle control circuit of the lambda probe arranged behind the catalytic converter.

In order, now, to compensate for the long-time drift of the lambda probe 5 in front of the catalytic converter, a second control circuit is present which contains the second lambda probe 6 behind the catalytic converter 2 and which is further explained in FIG. 4.

The control path 11 contains the motor 1 which is fed the actuating signal in the form of the modified injection time of the injection valves to the controller 8, as described in FIG. 1.

The lambda probe 6 arranged in the exhaust gas passage (or pipe) behind the catalytic converter 2 supplies a lambda value in the form of a signal voltage. At the start of every control cycle, it is checked whether the probe is active. This is done by determining whether this signal voltage is outside a voltage range (ULSU, ULSO). If it is, then a correction signal is formed in which the actual value ($U_{6IST}$) measured by the lambda probe 6 at a summation point 12, shown in FIG. 4, is compared with a desired value $U_{6SOLL}$) stored in the memory ROM of the controller. This desired value $U_{6SOLL}$ is formed from the mean value measured by the lambda probe 6 when the lambda probe 5, arranged in front of the catalytic converter, is operating properly.

The control difference between desired and actual value of the second lambda probe 6 formed at the point 12 is fed to a limiter 13 which compares the amount of the control difference with a threshold value 14 which is also stored in the memory ROM of the controller. Only if the amount of the control difference is greater than this threshold value is the control difference fed to a comparator 15 which gives off a 1 or a −1 as a function of the sign of the difference between the actual value $U_{6IST}$ of the second lambda probe 6 and the desired value $U_{6SOLL}$ of the second lambda probe 6. As a function of this value which is given off, a sign integrator 16 is incremented or decremented.

The sign integrator 16 is incremented by 1 if the actual value $U_{6IST}$ is greater than the desired value $U_{SOLL}$. It is decremented by 1 if the actual value $U_{6IST}$ is less than the desired value $U_{6SOLL}$. If the two values are the same, then the counter reading is not changed.

The sign integrator 16 is acted upon each change 17 of the first lambda probe 5 arranged in front of the catalytic converter 2 and is thus timed by it.

At a first multiplication point 18, the numerical value is multiplied by a proportionality constant 19 of a value of (0.5–several 100) ms per probe reversal of the first lambda probe 5, whereby an absolute hold time $TH_{rough}$ is determined. The hold time $TH_{rough}$ thus obtained is weighted by a weighting factor WF at a second multiplication point 20, that weighting factor being determined at the point 23 by division of the period 21 of the first lambda probe 5 actually measured by a constant 22. The constant 22 is in this connection a function of the period of the first lambda probe 5 upon idling.

In comparison with characteristic families customarily used at this place in the case of which the weighting factor can assume maximum values of 1, the actual disturbance is now compensated for regardless of its value, since a sort of self-strengthening is obtained by the larger factor. The hold time TH thus obtained is fed as closed loop control variable to the controller 8 for adaptation to the control path 11.

In addition to the hold time TH, a correction value, formed as follows, is fed to the control path 11.

The control difference of the second lambda probe 6 formed at the summation point 12 is fed to a change-over switch 24, which switches as a function of the sign of the signal(s) given off by the comparator 15. If the signal is negative, then a first evaluation factor KM is taken from a first characteristic curve 25; if the signal is positive, then a second evaluation factor KL for the control deviation is taken from a second characteristic curve. This evaluation factor KM or KL is multiplied at the point 27 by a third evaluation factor KF formed from a family of characteristics 28. The family of characteristics 28 is determined by the amplitude ratio mean value 29 of the two lambda probes 5 and 6 and the air mass flow 30 measured by the air mass meter 7.

The characteristic value KPF formed at point 31 is weighted by weighing unit 32 at the point 31 as a function of the probe reversal 17 of the first lambda probe 5 and of the sign of the control difference of the second lambda probe 6 which is obtained by the comparator 15.

If the signals of both probes are in the rich region, then a positive sign is present. If both probes are operating in the lean region, a negative sign is present.

The weighting of the correction factor KPF is effected in the following manner: If both probes 5, 6 are acting simultaneously in the rich region or simultaneously in the lean region, the correction factor KPF is increased by 1. If the first probe is operating in the rich region and the second probe in the lean region or vice versa, then the correction factor KPF is subtracted from 1. The weighting factor thus obtained is fed as a dimensionless variable independently of the hold time TH to the controller 8 in the control path 11. In this connection with a trend of the output signal of the two lambda probes 5, 6 in the same direction, the proportional portion of the controller 8 is increased and in the case of the opposite trend it is decreased, with the result that a rapid, direct action of the second lambda probe on the first lambda control circuit takes place.

During a determined analysis interval, the maxima and minima of the output signals of the first and second lambda probe are measured. The analysis interval is a fixed time period i.e. 100 ms, which will be continuously repeated during the operation of the combustion engine.

The amplitude values are formed from the minima and the maxima of the measured values of both lambda probes determined in the same analysis interval. The amplitude ratio results from the division of the amplitude values of the lambda probe 6 by those of the lambda probe 5. Depending on how many analysis intervals are examined, one amplitude ratio is formed for each analyses interval.

I claim:

1. A method of controlling the fuel/air ratio of an internal combustion engine for which a catalytic converter is provided in an exhaust gas passage of the engine, and wherein the output signal of a first lambda probe which is arranged in front of the converter in the exhaust gas passage of the internal combustion engine is fed to a controller which has a proportional-plus-integral (PI) characteristic, wherein the controller provides a setting variable for a fuel/air ratio, the method comprising steps of:

obtaining a further signal from the output signal of a second lambda probe arranged behind the catalytic converter;

feeding the further signal to the controller, and acting via the controller on a control circuit of the first lambda probe;

changing the amount of a jump in the proportional part P of the characteristic (P jump) of the PI controller which is caused by the control circuit of the first lambda probe as a function of the control circuit of the second lambda probe;

determining the signal amplitudes of both the first lambda probe and the second lambda probe by discrete scanning of the output signals of the respective ones of the lambda probes; and providing for each probe by a scanning within a time window, mean values of the amplitudes of the signals of respective ones of the lambda probes from which values the amplitude ratio is formed.

2. A method according to claim 1, further comprising steps of:

forming a correction signal value from a control deviation between an actual value of the second lambda probe and a desired value of the second lambda probe;

increasing, for the correction signal value, the P jump of the first lambda control circuit when the sign of the control deviation agrees with a tendency towards reversal of the first lambda probes; and reducing, for the correction signal value, the P jump of the first lambda control circuit when the sign of the control deviation is opposite the reversal trend of the first lambda probe.

3. A method according to claim 2, wherein, in said forming step, the correction signal value of the second lambda control circuit is formed at the time of a reversal of the first lambda probe arranged in front of the catalytic converter and is fed to the control circuit of the first lambda probe.

4. A method according to claim 3, wherein in said forming step, the correction signal value is formed as a function of air mass flow to the engine.

5. A method according to claim 3, wherein, in said forming step, the correction signal is formed as a function of the ratio of the signal amplitude of the second lambda probe to the amplitude of the first lambda probe.

6. A method according to claim 2, wherein, in said forming step, the correction signal value is formed as a function of air mass flow to the engine.

7. A method according to claim 2, wherein, in said forming step, the correction signal value is formed as a function of the ratio of the signal amplitude of the second lambda probe to the amplitude of the first lambda probe.

8. A method according to claim 2, further comprising a step of weighting the correction signal value as a function of the sign of the control deviation of the second lambda control circuit.

9. A method of controlling the fuel/air ratio of an internal combustion engine for which a catalytic converter is provided in an exhaust gas passage of the engine, and wherein the output signal of a first lambda probe which is arranged in front of the converter in the exhaust gas passage of the internal combustion engine is fed to a controller which has a proportional-plus-integral (PI) characteristic, wherein the controller provides a setting variable for a fuel/air ratio, the method comprising steps of:

obtaining a further signal from the output signal of a second lambda probe arranged behind the catalytic converter;

feeding the further signal to the controller, and acting via the controller on a control circuit of the first lambda probe;

changing the amount of a jump in the proportional part P of the characteristic (P jump) of the PI controller which is caused by the control circuit of the first lambda probe as a function of the control circuit of the second lambda probe;

forming a correction signal value from a control deviation between an actual value of the second lambda probe and a desired value of the second lambda probe;

increasing, for the correction signal value, the P jump of the first lambda control circuit when the sign of the control deviation agrees with a tendency towards reversal of the first lambda probe;

reducing, for the correction signal value, the P jump of the first lambda control circuit when the sign of the control deviation is opposite the reversal trend of the first lambda probe;

wherein, in said forming step, the correction signal value is formed as a function of air mass flow to the engine;

determining the signal amplitudes of both the first lambda probe and the second lambda probe by discrete scanning of the output signals of the respective ones of the lambda probes; and providing for each probe by a scanning within a time window, mean values of the amplitudes of the signals of respective ones of the lambda probes from which values the amplitude ratio are formed.

10. A method according to claim 9, wherein in said scanning, the signal amplitudes of both the first lambda probe and of the second lambda probe are determined by discrete scanning of the output signals of the respective lambda probes and, that, from the scanning within the time window there is a forming for each probe signal a mean value of the amplitude of each lambda probe, from which value the amplitude ratio is determined.

* * * * *